US005398635A

United States Patent [19]

Tellington

[11] Patent Number: 5,398,635

[45] Date of Patent: Mar. 21, 1995

[54] FLOATING AIRPORT

[76] Inventor: Wentworth J. Tellington, P.O. Box 68291, Tucson, Ariz. 85737

[21] Appl. No.: 154,119

[22] Filed: Nov. 18, 1993

[51] Int. Cl.[6] ..... B63B 35/00

[52] U.S. Cl. ..... 114/261; 114/144 B; 114/266

[58] Field of Search ..... 244/116, 114 R; 114/144 B, 258, 259, 260, 261, 262, 264, 265, 266, 270, 267

[56] References Cited

U.S. PATENT DOCUMENTS

| | | | |
|---|---|---|---|
| 1,513,591 | 10/1924 | Dorr et al. . | |
| 1,753,399 | 4/1930 | Blair . | |
| 1,854,336 | 4/1932 | King . | |
| 2,133,721 | 10/1938 | Seidman . | |
| 2,342,773 | 2/1944 | Wellman | 114/43.5 |
| 2,386,814 | 10/1945 | Rosendahl et al. | 244/116 |
| 2,991,743 | 7/1961 | Ogle | 114/261 |
| 3,191,566 | 6/1965 | Wilken et al. | 114/43.5 |
| 4,286,538 | 9/1981 | Matsui | 114/267 |
| 4,744,529 | 5/1988 | Clarke | 244/114 |

*Primary Examiner*—Stephen A. Avila

*Attorney, Agent, or Firm*—Antonio R. Durando; Harry M. Weiss

[57] ABSTRACT

A floating airport that consists of a multiple-deck structure floatingly supported by a plurality of independent hulls removably attached to the underside of the structure. A system of propulsion jets is provided on all sides to permit the motion of the structure in any desired direction relative to the water. The anchoring of the structure is achieved by dynamically monitoring the horizontal position of its center of gravity and by utilizing the propulsion system to avoid any significant movement with respect to a predetermined location. The structure is allowed to rotate approximately around its vertical axis in order to align the runways with the prevailing winds and minimize the winds' impact on its stability, and any translational motion of the center of gravity of the airfield with respect to the water surface is minimized. As a result of this position control strategy, the structure is prevented from ever acquiring significant linear momentum in spite of its large mass and its position can be continuously controlled with relatively minor adjustments that are within the capability of its propulsion system.

19 Claims, 3 Drawing Sheets

FLOATING AIRPORT

BACKGROUND OF THE INVENTION

1. Field of the Invention

This invention pertains to the general field of airstrips for aircrafts and, in particular, to floating structures adapted for use as bases for landing and take-off.

2. Description of the Prior Art

Ever since humankind embarked in the pursuit of flight, the question of providing suitable means and places for taking off and landing has been of paramount importance. As commercial and military aviation developed, it became increasingly critical to be able to land at specific destinations safely and efficiently, so that large numbers of aircrafts could be accommodated. Thus, civil and military aviation establishments have relied over the years on thousands of airports strategically located on land around the world and on airplane carriers at sea.

Modern airports have become mazes of runways, hangars and terminals used to move millions of people and tons of cargo material every day. Problems of congestion, security, safety, noise, pollution, and distance from residential areas all contribute to sometime contradictory solutions for urban airports. The high traffic volume of a modern metropolis requires sufficient runways to take care of very frequent landings and take-offs. Therefore, even smaller airports have multiple runways spread out over several square kilometers of premium land. In addition, since the optimal direction for both take-off and landing maneuvers changes with the direction of the prevailing wind, multiple sets of intersecting runways are usually provided, creating a system of paved roads many kilometers long in all directions. This causes airplanes to taxi over long distances before and after each flight, wasting fuel and passenger time and contributing to environmental pollution.

One other aspect of urban airports is that they need to be accessible and yet far enough from residential areas to avoid unacceptable levels of noise. As a result, either they are placed tens of kilometers from town or the allowed flight patterns are adjusted to avoid maneuvers directly over populated areas. The former case complicates the logistics of travel for the average passenger who has to face a relatively time-consuming journey to and from the airport in addition to flight time. The flight pattern constraints are particularly significant in bad weather because they force the performance of suboptimal landings as a result of the restrictions, increasing the danger of mid-air collisions and problems on impact.

Various inventions have been described in the prior art to address particular air navigation needs. For example, U.S. Pat. No. 1,513,591 to Dorr et al. (1924) discloses the idea of a floating hangar for airships based on a single-hull design. The invention first introduces the concept of utilizing the unitary construction of a ship's hull to provide the buoyancy required for supporting the shed above water. Flood chambers are used to elevate or lower the bottom of the hanger to the desired elevation with respect to water level. The structure is provided with a single-point anchoring system that permits the rotation of the shed to face the wind. Although the purpose of this feature is not expressly stated, it was presumedly intended for stability and for facilitating the process of taking airships aboard.

U.S. Pat. No. 1,854,336 to King (1932) describes a floating landing strip, seemingly a precursor to modern airplane carriers. The invention relates to a runway supported by multiple submergible pontoons that permit the raising or lowering of the unit. The structure is propelled and intended for navigation and anchoring on large bodies of water.

In U.S. Pat. No. 1,753,399 (1930), Blair describes an ocean-going aircraft-carrying structure with a system of hulls designed to reduce the impact of wave motion. The bulk of the volume of the hulls is under the water level, so that the impact of surface-water motion is minimized.

In U.S. Pat. No. 2,133,721 (1938), Seidman describes an airplane terminal having a submersed rotating platform for retrieving and releasing aquatic airplanes. The invention is directed at means for coordinating passenger and cargo traffic between land and arriving or departing hydroplanes.

U.S. Pat. No. 2,342,773 to Wellman (1944) discloses a landing platform formed on the surface of a body of water adjacent to a ship. The platform is made with material carried by the ship in rolled form and reeled offboard over the water to create a landing strip when needed. Inflatable compartments are provided for buoyancy.

U.S. Pat. No. 3,191,566 to Wilken et al. (1965) shows a water-borne craft for airplanes capable of attaining the normal speed of a plane during landing. As a result of this feature, which is achieved with hydrofoil technology, the vessel is able to provide a relatively stationary target for landing airplanes and to enhance the take-off air velocity of departing aircrafts.

Finally, U.S. Pat. No. 4,744,529 to Clarke (1988) teaches a system for recovering disabled airplanes in water. It consists of a large net having sufficient size to accommodate an aircraft during landing in water and comprises floats for supporting the net and craft. The system is designed for emergency operation in conjunction with a tug boat.

None of the concepts described by the prior art address the above-mentioned problems of modern airports, nor suggest solutions to them. Therefore, there still exists a need for a new type of airport that optimizes space utilization, safety, convenience, and efficiency of operation.

BRIEF SUMMARY OF THE INVENTION

It is therefore an objective of this invention to provide a new concept in airport design based on a floating structure located on a body of water in the proximity of an urban center, providing a water buffer between airstrips and residential areas in all directions, such that landings and take-offs may occur in all directions with minimal disturbance to populated areas.

Another objective of the invention is a structure that can be rotated to face the prevailing wind, so that a single set of parallel runways is sufficient to ensure optimal landing and take-off conditions at all times.

Another goal of the invention is a method of continuously monitoring and controlling the position of the platform to ensure its stability under all weather and water conditions.

A further objective of the invention is a modular approach to the design of the airport structure that is suitable for repairs, additions and modification over a long period of operation.

Another goal of the invention is a system of supporting hulls to provided the required buoyancy that is stable under all wave conditions and nearly unaffected by surface water motion.

Finally, another goal of the invention is the utilization of known scientific principles in combination with existing technology, including sensory, computing, control, communication and other devices, for the achievement of the above-stated objectives.

Thus, in accordance with these and other objectives, the floating airport of this invention consists of a multiple-deck structure floatingly supported by a plurality of independent hulls removably attached to the underside of the structure. A system of propulsion jets is provided on all sides to permit the motion of the structure in any desired direction relative to the water. The anchoring of the structure is achieved by constantly monitoring the horizontal position of its center of gravity and by utilizing the propulsion system to avoid any significant movement with respect to a predetermined location. The structure is allowed to rotate approximately around its vertical axis in order to align the runways with the prevailing winds and minimize the winds' impact on its stability, but any translational motion of the center of gravity of the airfield with respect to the water surface is minimized. As a result of this position control strategy, the structure is prevented from ever acquiring significant linear momentum in spite of its large mass and its position can be continuously controlled with relatively minor adjustments that are within the capability of its propulsion system.

Various other purposes and advantages of the invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose only some of the various ways in which the invention may be practiced.

DETAILED DESCRIPTION OF THE INVENTION

The idea of designing an airport as a floating structure provides a simple theoretical solution to the problems of modern airfields. In practice, though, the implementation of the idea requires a solution to many yet unresolved issues that are critical to the viability of the concept. The main issue concerns a method of stably anchoring a floating structure of the size of an airport and safely securing its position under all weather conditions. Huge ships, such as aircraft carriers, have been built and are obviously routinely secured at will by anchoring systems that tie them to fixed structures such as piers or the ocean floor. These anchoring means, though, are not deemed reliable enough for a structure that is much larger and heavier than any ship ever built and that is not designed for travel, therefore lacking sufficient self-propulsion to meet emergency situations. The floating airport of the invention is contemplated to comprise at least two decks (although a single-deck construction would also fall within the scope of the invention) and span over an area about 1,000 meters wide and 5,000 meters long. No anchoring system has ever been devised that could be relied on for such a massive structure. The main contribution of this invention is to provide a means for safely and reliably securing the position of a floating airport.

Figure 1:
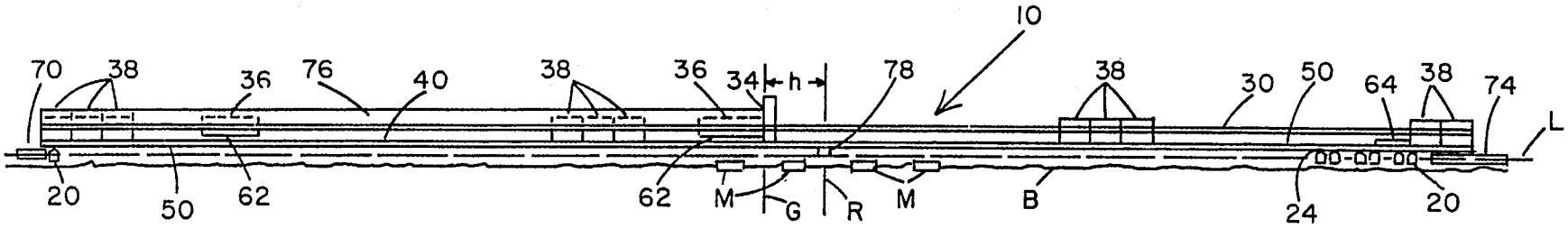
FIG. 1 illustrates in elevational side view the general configuration of a floating airport according to this invention consisting of an upper flight deck, a lower service deck and partially-submerged modular pontoons to support the deck structure afloat.
Figure 2:
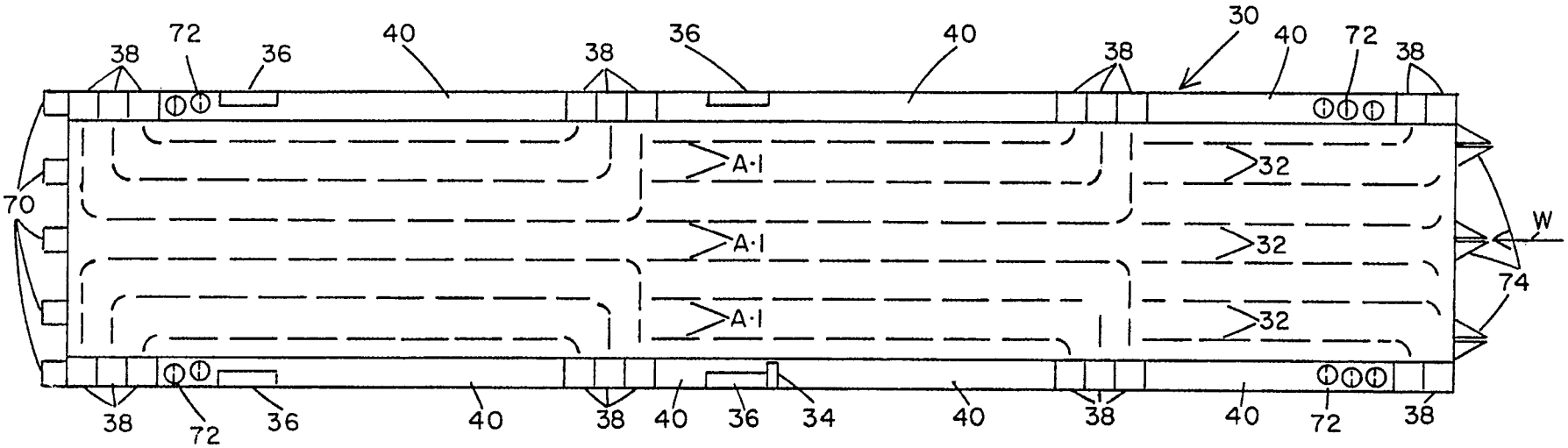
FIG. 2 is a schematic plan view of the upper flight deck of the invention.
Figure 3:
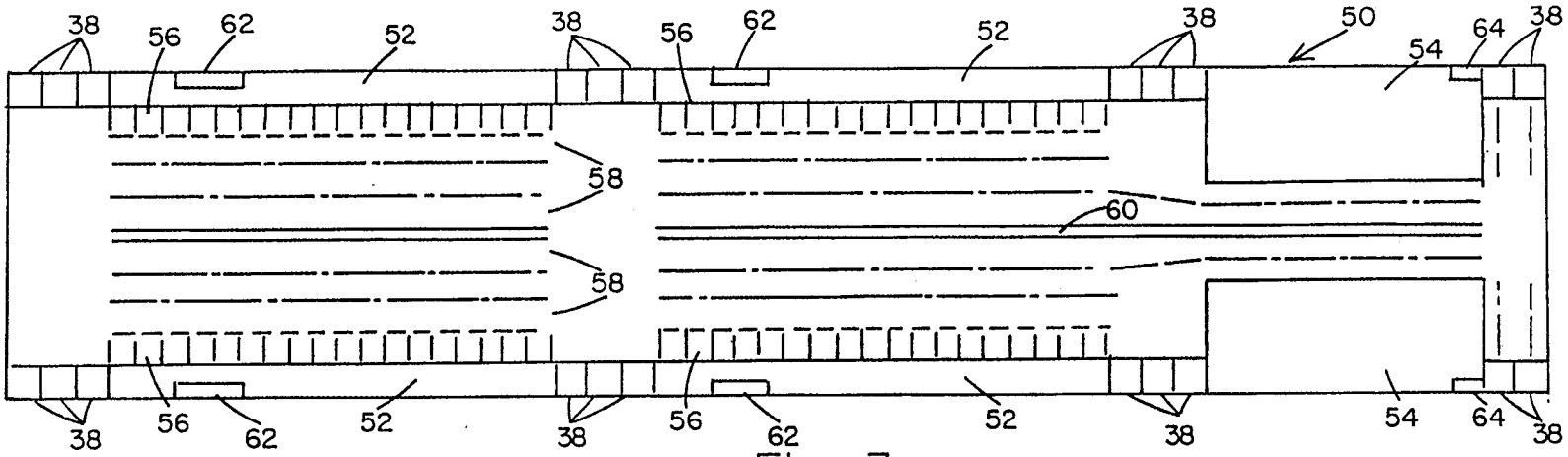
FIG. 3 is a schematic plan view of the lower service deck of the invention.

Referring to the drawings, wherein the same reference numerals and symbols are used throughout to designate like parts, FIG. 1 illustrates in elevational side view the general configuration of a floating airport 10 according to this invention. The airport comprises multiple decks (two are shown in the figures and used in this disclosure for illustration, but more could obviously be utilized in equivalent fashion) supported by a plurality of floating pontoon hulls removably attached to the bottom of the lower deck. As seen in the figure, each pontoon hull 20 is partially submerged under the surface L of the body of water supporting the airport and provides buoyancy to the structure. As also illustrated in the schematic plan view of FIG. 2, an upper flight deck 30 contains multiple longitudinal runways 32 (shown with reference to directional arrows A1), at least one flight-control tower 34, helicopter pads 36, elevators 38 connecting the top deck 30 to a lower service deck 50, and several emergency/safety areas 40. The lower deck 50, shown in schematic plan view in FIG. 3, comprises passenger ticket/baggage areas 52, aircraft maintenance and repair facilities 54, airplane parking bays 56, airplane-tow traffic lanes 58 for arrival and departure, and at least one tow vehicle lane 60. The airplanes are moved to and from the upper deck 30 by means of the elevators 38 connecting the two decks. Passenger-boat landings 62 and service-boat landings 64 are provided along the perimeter of the lower deck for accessing the airport by boat from shore.

Figure 4:
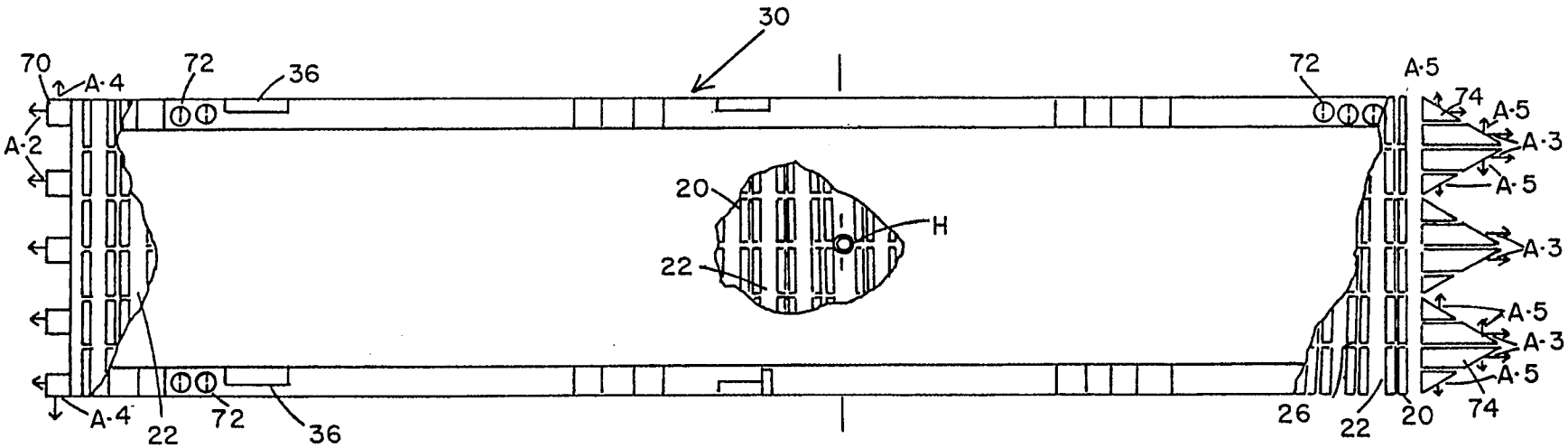
FIG. 4 is a schematic plan view of the airport of the invention with cut-out portions to illustrate the layout of the supporting floating hulls.
Figure 6:
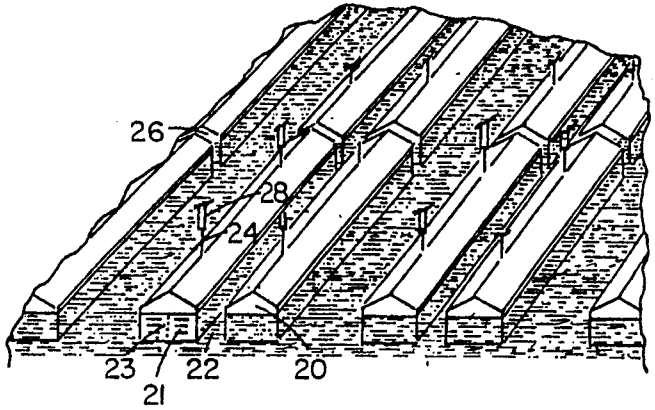
FIG. 6 is an enlarged perspective view of the floating hulls to illustrate their transverse arrangement to form longitudinal wind channels therebetween.
Figure 5:
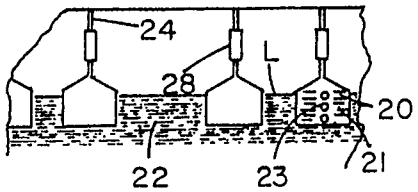
FIG. 5 is an enlarged elevational view of the floating hulls of the invention to illustrate their longitudinal arrangement to form transverse access channels therebetween.

Cut-out portions of FIG. 4 show in plan view the layout of the floating hulls 20 within the structure of the airport. Each hull 20 consists of an independent module with sufficient buoyancy to support its own weight and also a portion of the weight of the multi-deck structure in proportion to the total number of hulls used. Each hull is rigidly mounted to the bottom of the lower deck and preferably placed adjacent to another hull transversely along the width of the airport, each pair of hulls being sufficiently apart from other pairs to form transverse access channels 22 therebetween that can be used for maintenance or for removing and replacing damaged hulls. As illustrated schematically in FIGS. 5 and 6, each hull 20 is removably secured to the lower deck 50 through posts or equivalent means 24 and each pair of hulls 20 is also uniformly spaced from laterally adjacent pairs to form longitudinal wind channels 26. This modular-hull concept is greatly preferred over a very large single hull because it facilitates movement of the overall structure by providing longitudinal and lateral channels of flow for the surrounding water, thus affording much greater flexibility of operation and maintenance. It is calculated that approximately 500 modular hulls (each about 150 meters long and 30 meters wide) would be required to support a five-kilometer long airport structure; a single-hull approach would make lateral movement of such a structure virtually impossible because of the huge barrier it would provide to water flow.

Although not specifically illustrated in the drawings, large-scale construction techniques well known to those skilled in the art can be used for removably mounting each hull 20 under the airport's multi-deck structure. As shown for illustration on one of the posts 24 of FIG. 6, a hydraulic cylinder 28 can be used to provide shock absorption, so that vertical surges of the water surface are prevented from causing rapid movements of the decks and resulting stresses on the structure are reduced. Each hull 20 is independently equipped with flood chambers 21 and pumps 23 (shown only on one hull for simplicity) to control its buoyancy, so that the air field may be raised or lowered with reference to the water level as weather or other conditions may warrant. Similarly, a hull may be lowered with respect to the others to facilitate its disengagement from the structure and removal via the access channels 22.

The propulsion system of the preferred embodiment of the invention consists of a plurality of large water jets disposed preferably in the fore and aft portions of the structure below the water surface. Because of the method adopted to control the position and stability of the floating structure, only a limited number of jets is critical to provide the necessary mobility. In operation, the airport is oriented to always face the prevailing wind W, so that forward propulsion is constantly required under normal conditions to overcome the force of the wind and keep the airport stationary. Thus, banks of pump-driven stern jets 70 adapted to eject directly to the rear of the structure (as indicated by arrows A2 in FIG. 4) are used to provide forward thrust. By mounting a series of wind generators 72 in strategic positions along the flight deck or on the sides of the structure, the force of the wind can concurrently be used to generate power for operating the jet pumps. Since the forward thrust required to maintain the longitudinal position of the airport and the power generated by the wind generators will both be proportional to the force of the wind at all times, additional power requirements are minimized by this combination. Banks of smaller bow jets 74 (propelling forward in the directon of arrows A3 in FIG. 4) are similarly used to thrust the structure 10 backwards in case of a sudden reversal of wind direction. Inasmuch as the direction of the wind is to be monitored and forecast continuously and used for controlling the attitude of the airport to ensure its is windward position at all times, thereby being normally subjected to a bow head wind, it is expected that these jets would rarely be used and are provided for emergency situations only.

Steering of the structure 10 is achieved by lateral jets which may be incorporated within the banks 70 and 74 in the stern and bow portions of the airport. When the wind direction changes or the structure rotates, thereby facing the wind either at port or starboard, steering for realignment can be achieved by jets that utilize water sucked in from one side of the bank and propel it toward the opposite side. As indicated by arrows A4 in FIG. 4, the stern jets are adapted to provide thrust in either lateral direction, depending on the wind, and are used so as to eject on the windward side with intake from the leeward side. Similarly, as indicated by arrows A5, the bow jets are adapted to provide thrust in either lateral direction as well, but they are used so as to eject on the leeward side with intake from the windward side. This mode of operation of the jet banks creates a torque approximately about the vertical axis of the structure 10 and permits its longitudinal realignment with the direction of the wind simply by rotation around that axis and without translational displacement of the center of gravity.

Figure 7:
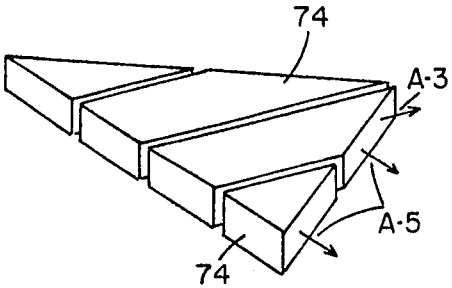
FIG. 7 is an enlarged perspective view of the propulsion-jet banks in the bow of the airport structure to illustrate their aerodynamic and hydrodynamic profile.

Because of the elongated shape of the structure 10 and the presence of the wind channels 26 between the water surface and the bottom of the lower deck 50, the wind itself provides a force tending to maintain the longitudinal alignment of the airport in windsock fashion. As illustrated in schematic form in FIG. 7, the banks of jets 74 in front of the airport are preferably shaped with an aerodynamic and hydrodynamic profile in the longitudinal direction, designed to direct the wind in fin fashion into the wind channels 26. This effect is magnified by providing greater wind resistance on the portion of the structure behind its vertical axis, such as by lateral shields 76 (see FIG. 1), than on the fore portion of the airport. In fact, the front portion of the airport is purposefully largely open and wind absorbing, while the rear portion is preferably completely walled in to help its rotation.

In addition, the effect of the wind is further enhanced by controlling the rotation of the structure so that the axis of rotation R (FIG. 1) is kept in front of its vertical axis G (which, by definition, passes through the center of gravity), thus creating a torque with an arm equal to the distance h between the axis of rotation and the center of gravity with a component in the direction required to effect the longitudinal realignment of the airport. It is estimated that a distance h of 250 meters would be optimal for a 5-km long deck structure; that is, the optimal lever arm for the purposes of this invention is estimated to be about 5 percent of the length of the structure. A range of zero to 25 percent may be used under different conditions. For example, the distance h may be changed during operation as a result of a change in the load distribution on the structure 10, such as when an unusual number of heavy airplanes is stowed away in a particular area like a maintenance hanger or the like. Thus, the control stability of the floating airport can be further improved by dynamically adapting the distance h to an optimal value for given weight-distribution and wheather conditions, as one skilled in the art would be able to determine.

The position-control and anchoring system for the floating airport of the invention is not based on structural ties with stationary monuments, such as massive foundations onshore or offshore or on the bottom B of the water body; rather, it is based on the continuous dynamic control of the position of the floating structure 10 while it is free to move on the surface of the water. This freedom of motion makes it possible to always orient the structure longitudinally into the wind, so that the runways are always disposed optimally for landing and take-off irrespective of the wind direction. The stern propulsion system provides the thrust necessary to keep the airfield stationary in the longitudinal direction against the wind, the magnitude of that thrust obviously varying from time to time depending on wind conditions. The position-control system comprises means for sensing the coordinates of the chosen axis of rotation R, illustrated as passing through an imaginary rotation hub H in FIG. 4, with respect to stationary reference points M (at least three are required for triangulation purposes) at the bottom of the water body (FIG. 1) or onshore. Such a system could be based on sonar, laser or equivalent technology, as is well known in the art of navigation, and would simply involve telemetry apparatus 78 for generating and/or receiving signals representative of distances from the stationary reference monuments M and data processing apparatus (shown as combined with referenced apparatus 78) for converting the distance information so acquired into a control signal for activating the proper jets to bring the hub H to its intended position. Angular deviations from the desired longitudinal attitude (which is always determined by the direction of the prevailing wind) would similarly be measured and appropriate action taken. By continuously monitoring the position of the hub H in relation to its intended stationary location and by making adjustments as soon as deviations are measured (both linear and angular), the location and orientation of the airfield can be controlled dynamically and kept substantially fixed, such as if it were rigidly anchored. This feature makes it possible to quickly adjust the orientation of the airstrips to match the wind direction without having to first release the structure from a rigid anchoring structure.

Figure 8:
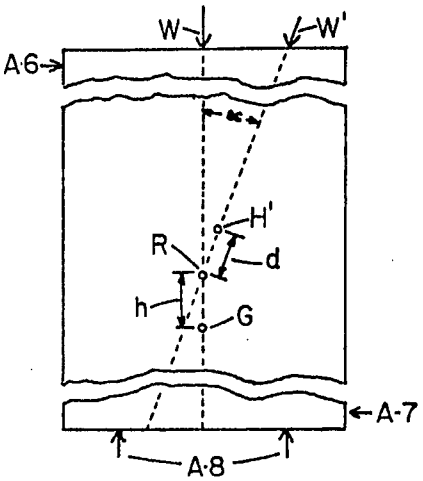
FIG. 8 is a schematic illustration of the control method of the invention.

As illustrated for example in the diagram of FIG. 8, as a result of changes in water conditions or in wind direction from W to W', the hub H will from time to time deviate from its intended stationary position H' by a measurable linear distance d and the direction of the airfield will deviate from its intended wind alignment by an angle $\alpha$. Lateral thrust would then be applied to the port and stern of the structure in the direction of arrows A6 and A7 to cause it to rotate windward about the vertical axis R through the hub H. At the same time, forward thrust in the direction of arrows A8 would be applied at the stern of the structure to move the hub H toward its intended location H'. By continuously monitoring the coordinates and orientation of the hub H with respect to H' and by immediately correcting both linear and angular deviations, the structure is never allowed to deviate substantially from its intended position. The maneuverability of the structure is also enhanced by the modular hull configuration described above, which facilitates the displacement of water that is necessary to allow the structure to move swiftly. Thus, though huge in size and mass, the floating airport never develops sufficient linear and/or angular momentum to overwhelm the capacity of its jet propulsion system; rather, it can be controlled continuously within narrow perturbations that ensure a very stable and substantially stationary operation of the structure as a floating airfield.

It is understood that many equivalent systems are possible within the scope of the present invention, with different embodiments, for example, for the decks, propulsion system, and navigation apparatus. In addition, it is understood that various other features would added to the basic concept for a floating airport in order to construct a fully functional facility. Fuel tanks and lines, sewer and waste disposal apparatus, and a water supply system, which may be based on a self-contained purification plant drawing water from the surrounding body, could all be incorporated within the hull structure below the lower deck. In addition, an emergency, stationary anchor could be provided for safety in case of total failure of the onboard systems. Such an anchor would necessarily be kept inoperative under normal conditions, such as by being slack within a radius greater than the normal deviation of the hub H from its stationary target H'.

Figure 9:
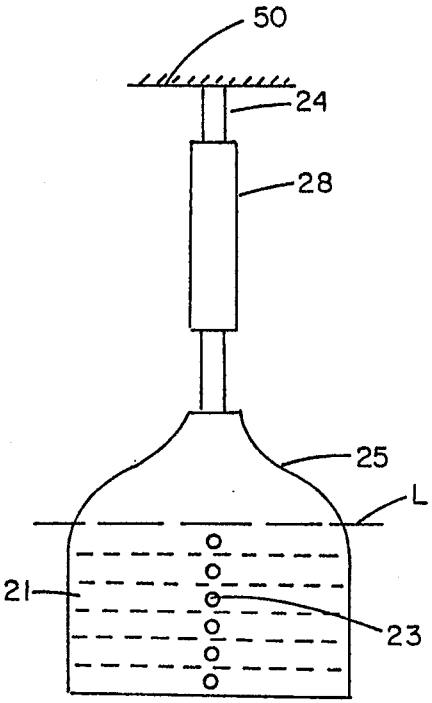
FIG. 9 is an elevational side view of an alternative embodiment of the modular pontoon hulls of the invention.

It is well known that the top few feet of water are mostly affected by adverse weather conditions over a lake or ocean, while the bottom waters tend to remain relatively calm and unaffected by high winds. Accordingly, the stability of the floating structure of the invention can be further enhanced by using a specific embodiment 25 for the supporting floating hulls according to the design shown in cross-section in FIG. 9. Each hull 25 has an approximately pear-shaped cross-section (converging to a thinner top portion) and is also independently equipped with flood chambers 21 and pumps 23 to control its buoyancy, as discussed above for hulls 20. By operating the hull 25 so that the bulk of its volume is well below the surface of the water L, the exposure of the hull to surface conditions is greatly diminished and the airport structure supported by the hulls becomes more stable in bad weather.

In all cases, the length of the posts 24 will be chosen so as to provide sufficient clearance below the lower deck 50 to allow a 20- to 30-foot wave to pass under the structure with limited impact on its stability. This feature can be enhanced by designing the hulls 20 or 25 so that they operate mostly submerged under normal conditions, thus providing minimal resistance to the motion of surface water, which is where most of the turbulence is experienced during bad weather conditions. Through the use of the flood chambers 21 and pumps 23, the position and stability of the structure 10 can be further improved by selectively changing the buoyancy of specific hulls to meet corresponding requirements to balance the weight load throughout the airport. Finally, as an emergency option, the hulls should be capable (through flooding of its chambers) of allowing the sinking of the structure to the point where the bottoms of the hulls rest on the bottom B of the water body, thus providing a stable rigid anchor for the airport that would withstand any foreseeable situation. Because of the expected proximity to shore of airports built according to this invention, they would be placed in relatively shallow waters and their hulls in most cases would contact the bottom before the airport became submerged, thus avoiding damage to it even in such cases of extreme emergency.

Thus, various changes in the details, steps and materials that have been described may be made by those skilled in the art within the principles and scope of the invention herein illustrated and defined in the appended claims. While the present invention has been shown and described herein in what is believed to be the most practical and preferred embodiment, it is recognized that departures can be made therefrom within the scope of the invention, which is therefore not to be limited to the details disclosed herein, but is to be accorded the full scope of the claims so as to embrace any and all equivalent apparatus and methods.

I claim:

1. A floating-airport structure having a longitudinal dimension with a fore portion disposed approximately windwardly and an aft portion correspondingly disposed approximately leewardly, comprising:

at least one deck comprising take-off, landing, maintenance, passenger and cargo service facilities;

a plurality of modular hulls independently mounted under said deck and disposed so as to form longitudinal wind channels and transverse access channels whereby said hulls may be accessed and removed;

means for determining an angular deviation between said structure's longitudinal axis and a direction of a prevailing wind;

means for determining a translational deviation between a predetermined vertical axis of rotation in said structure and a stationary vertical reference axis;

means for effecting a rotation of said structure about said predetermined vertical axis of rotation so as to minimize said angular deviation, thereby causing the structure to be positioned substantially windwardly; and means for effecting a translational movement of said predetermined vertical axis of rotation in the structure toward said stationary vertical reference axis so as to minimize said translational deviation, thereby causing said two axes to substantially coincide;

whereby the floating-airport structure is maintained in a windward position approximately at rest with respect to said stationary vertical reference axis.

2. The floating-airport structure of claim 1, wherein at least one of said plurality of modular hulls comprises flood chambers and a pumping system for controlling said at least one hull's buoyancy.

3. The floating-airport structure of claim 1, wherein at least one of said plurality of modular hulls is pear-shaped and adapted for substantially-submerged operation.

4. The floating-airport structure of claim 2, wherein at least one of said plurality of modular hulls is pear-shaped and adapted for substantially-submerged operation.

5. The floating-airport structure of claim 1, wherein said means for effecting a rotation of said structure about said predetermined vertical axis of rotation so as to minimize said angular deviation consists of a plurality of propulsion jets disposed around said structure and adapted to provide lateral thrust thereto.

6. The floating-airport structure of claim 1, wherein said means for effecting a translational movement of said predetermined vertical axis of rotation in the structure toward said stationary vertical reference axis so as to minimize said translational deviation consists of a plurality of propulsion jets disposed around said structure and adapted to provide forward and backward thrust thereto.

7. The floating-airport structure of claim 1, wherein said predetermined vertical axis of rotation is chosen to pass through a point located in front of said structure's center of gravity by a distance equal to zero to 25 percent of said structure's longitudinal dimension.

8. The floating-airport structure of claim 1, wherein said predetermined vertical axis of rotation is chosen to pass through a point located in front of said structure's center of gravity by a distance equal to about five percent of said structure's longitudinal dimension.

9. The floating-airport structure of claim 1, further comprising wind generators connected to said means for effecting a rotation of said structure and to said means for effecting a translational movement of said predetermined vertical axis of rotation in the structure.

10. The floating-airport structure of claim 1, further comprising lateral wind shields mounted on said aft portion of the structure to provide greater wind resistance than is provided by said fore portion.

11. The floating-airport structure of claim 1, wherein said structure is approximately 5,000 meters long and 1,000 meters wide, and said plurality of modular hulls consists of approximately 500 units each about 150 meters long and 30 meters wide.

12. The floating-airport structure of claim 1, further comprising wind generators connected to said plurality of propulsion jets adapted to provide lateral thrust and to said plurality of propulsion jets adapted to provide forward and backward thrust, and comprising lateral wind shields mounted on said aft portion of the structure to provide greater wind resistance than is provided by said fore portion;

wherein at least one of said plurality of modular hulls comprises flood chambers and a pumping system for controlling said at least one hull's buoyancy; wherein at least one of said plurality of modular hulls is pear-shaped and adapted for substantially-submerged operation; wherein said means for effecting a rotation of said structure about said predetermined vertical axis of rotation so as to minimize said angular deviation consists of a plurality of propulsion jets disposed around said structure and adapted to provide lateral thrust thereto; wherein said means for effecting a translational movement of said predetermined vertical axis of rotation in the structure toward said stationary vertical reference axis so as to minimize said translational deviation consists of a plurality of propulsion jets disposed around said structure and adapted to provide forward and backward thrust thereto; and wherein said predetermined vertical axis of rotation is chosen to pass through a point located in front of said structure's center of gravity by a distance equal to about five percent of said structure's longitudinal dimension.

13. A method of anchoring a self-propelled floating structure by dynamically controlling the structure's position with respect to a stationary reference axis, said structure having a longitudinal dimension with a fore portion disposed approximately windwardly and an aft portion correspondingly disposed approximately leewardly, and said structure consisting substantially of at least one deck comprising take-off, landing, maintenance, passenger and cargo service facilities, and a plurality of modular hulls independently mounted under said deck and disposed so as to form longitudinal wind channels and transverse access channels, the method comprising the following steps:

(a) providing first means for determining an angular deviation between said structure's longitudinal axis and a direction of a prevailing wind;

(b) providing second means for determining a translational deviation between a predetermined vertical axis of rotation in said structure and a stationary vertical reference axis;

(c) providing third means for effecting a rotation of said structure about said predetermined vertical axis of rotation;

(d) providing fourth means for effecting a translational movement of said predetermined vertical axis of rotation in the structure toward said stationary vertical reference axis;

(e) using said first and second means to determine said angular and translational deviations;

(f) using said third means to cause a rotation of the structure around said predetermined vertical axis of rotation so as to minimize said angular deviation;

(g) using said fourth means to cause a translational movement of said predetermined vertical axis of rotation in the structure toward said stationary vertical reference axis so as to minimize said translational deviation; and (h) repeating steps (e)–(g) on a continuous basis so as to provide a dynamic position control function whereby the floating-airport structure is maintained at all times in a windward position and approximately at rest with respect to said stationary vertical reference axis.

14. The method of claim 13, wherein said third means provided in step (c) for effecting a rotation of said structure about said predetermined vertical axis of rotation consists of a plurality of propulsion jets disposed around said structure and adapted to provide lateral thrust thereto.

15. The method of claim 13, wherein said fourth means provided in said step (d) for effecting a translational movement of said predetermined vertical axis of rotation consists of a plurality of propulsion jets disposed around said structure and adapted to provide forward and backward thrust thereto.

16. The method of claim 13 wherein said predetermined vertical axis of rotation is chosen to pass through said structure's center of gravity.

17. The method of claim 13 wherein said predetermined vertical axis of rotation is chosen to pass through a point located in front of said structure's center of gravity by a distance equal to about zero to 25 percent of said structure's longitudinal dimension.

18. The method of claim 13, further comprising the step of providing wind generators connected to said third means provided in step (c) for effecting a rotation of said structure and to said fourth means provided in step (d) for effecting a translational movement of said predetermined vertical axis of rotation in the structure.

19. The method of claim 13, further comprising the step of providing lateral wind shields mounted on said aft portion of the structure to provide greater wind resistance than is provided by said fore portion.

* * * * *